US005144694A

United States Patent [19]

Conrad Da oud et al.

[11] Patent Number: 5,144,694

[45] Date of Patent: Sep. 8, 1992

[54] EXERCISE APPAREL AND WEIGHT PACKETS

[75] Inventors: Emilie Conrad Da oud, Woodland Hills; Eleanor Zimmerman, Venice, both of Calif.

[73] Assignee: Explore Incorporated, Santa Cruz, Calif.

[21] Appl. No.: 666,525

[22] Filed: Mar. 9, 1991

[51] Int. Cl.[5] ..... A41D 1/08

[52] U.S. Cl. ..... 2/69; 2/102; 2/311; 2/338; 2/228; 2/227; 2/170; 2/238; 2/DIG. 6; 482/105

[58] Field of Search ..... 2/69, 102, 170, 311, 2/338, 228, 227, 238, DIG. 6; 272/117, 119

[56] References Cited

U.S. PATENT DOCUMENTS

| | | | |
|---|---|---|---|
| 3,525,141 | 8/1970 | Smith | 272/119 |
| 4,268,917 | 5/1981 | Massey | 272/119 |
| 4,303,239 | 12/1981 | Walsh, Jr. | 272/119 |
| 4,344,620 | 8/1982 | Debski | 2/102 |
| 4,382,302 | 5/1983 | Watson | 2/102 |
| 4,384,369 | 5/1983 | Prince | 2/79 |
| 4,394,012 | 7/1983 | Egbert et al. | 2/102 |
| 4,407,497 | 10/1983 | Gracie | 2/67 |
| 4,658,442 | 4/1987 | Tomlinson et al. | 2/102 |
| 4,953,856 | 9/1990 | Fox III | 272/119 |
| 4,958,386 | 9/1990 | Louis-Jeune | 2/227 |
| 4,974,398 | 12/1990 | Kaski | 272/119 |
| 4,989,267 | 2/1991 | Watson | 2/102 |
| 5,002,270 | 3/1991 | Shine | 2/102 |
| 5,010,596 | 4/1991 | Brown et al. | 2/228 |

*Primary Examiner*—Werner H. Schroeder
*Assistant Examiner*—Gloria Hale
*Attorney, Agent, or Firm*—Spensley Horn Jubas & Lubitz

[57] ABSTRACT

Exercise or physical therapy apparel including a vest, pants, spine strap, belt, wrist bands, ankle bands and weight packets. The vest and the pants are each provided with structure for holding at least one weight packet. The weight packets include plural rows and plural columns of weight members adjacent a layer of padding inside of a cloth pouch.

21 Claims, 2 Drawing Sheets

EXERCISE APPAREL AND WEIGHT PACKETS

BACKGROUND OF THE INVENTION

1. Field of the Invention

The present invention relates generally to exercise or physical therapy apparel and weight packets therefor.

2. Related Art

Over the last decade, public interest in health and fitness activities has increased dramatically. People are exercising more, eating better and, generally, engaging in activities for enhancing their physical health.

Various types of apparel have been designed for exercise or physical therapy activities. With the recent increase of public interest in personal physical health, such apparel has become very popular in recent years.

Some of such known apparel can be categorized as "weighted apparel", wherein the garments are provided with pockets or other mechanisms for holding weights. Various types of "weighted apparel" are exemplified in several recently issued U.S. patents.

For example, U.S. Pat. No. 4,384,369 to Prince (issued May 24, 1983) describes an "exercise suit" having a jacket and pants. Numerous pockets are spaced about the outside of the jacket and pants. The pockets carry bags of liquid which provide a weighted load. However, such liquid filled bags tend to be bulky and uncomfortable to carry. Furthermore, the liquid tends to slosh around, constantly changing pressure points and offsetting balance, during physical motions of the wearer's body.

As another example, U.S. Pat. No. 4,382,302 to Watson (issued May 10, 1983) describes a "weighted training vest having several weight blocks which independently attach to panels of the vest by "weight attaching members". The weight blocks secure to the weight attaching members with loop and hook self-gripping fastening devices of the type sold under the trademark VELCRO. Straps wrap around the vest and a wearer's torso to pull the panels of the vest snug against the wearer's chest and back. However, such rigid weight blocks tend to be relatively bulky and uncomfortable when held against a wearer's body and tend to pull away from and separate from the wearer's body as the wearer bends or stretches in various manners.

U.S. Pat. No. 4,602,387 to Zakrzewski (issued Jul. 29, 1986) describes another weighted vest wherein a number of independent weight bars are held in a corresponding number of pockets along the chest and back panels of the vest. Yet another weighted vest is described in U.S. Pat. No. 4,394,012 to Egbert et al. (issued Jul. 19, 1983) wherein a number of "weight capsules" fit snugly into a corresponding number of pockets provided over the chest and back panels of the vest. U.S. Pat. No. 4,658,442 to Tomlinson et al. (issued Apr. 21, 1987) describes another weighted vest which includes a number of pockets designed to receive a corresponding number of weights. Each weight has a dense solid core of lead or lead alloy surrounded by a padded coating. However, "weight bars," 37 weight capsules" and weights such as described in these patents are relatively large, bulky, rigid members which suffer many of the same disadvantages mentioned above with respect to the Watson patent.

U.S. Pat. No. 4,303,239 to Walsh, Jr. (issued Dec. 1, 1981) describes a device which straps to a user's thighs and which includes pockets for holding canvass or vinyl tubes of weighted matter, such as lead shot or sand. However, the lead shot or sand tends to shift around inside of the tubes during physical activity. Additionally, the sand or shot filled tubes tend to be relatively large and bulky.

U.S. Pat. No. 4,958,386 to Louis-Jeune (issued Sep. 25, 1990) describes athletic leg wear which is provided with removable pocket assemblies, each pocket assembly having one or more pockets adapted to hold one or more weights. However, the arrangements of weights within pockets, as described in the patent tends to be relatively rigid and inhibits bending in plural directions. Additionally, the patent is directed to a leg wear garment as opposed to a garment to be worn above the waist or a full body garment.

U.S. Pat. No. 4,953,856 to Fox, III (issued Sep. 4, 1990) describes an exercise garment for holding weights at locations chosen for strengthening muscles used in walking and running and for improving walking and running form. The garment includes upper leg straps having weights at positions along the hamstring, lower leg straps having weights at positions in the back of the calves and a waistband formed of neoprene. An upper waist strap joins a T-shaped section which follows the spine and which includes a weight extended along the spinal cord and weights behind the shoulders and upper arms.

U.S. Pat. No. 4,407,497 to Gracie (issued Oct. 4, 1983) describes a weighted exercise suit which includes two "weight strips" that are removably attached to the suit over the shoulders. The weight strips secure to the suit by VELCRO fastening means. Each weight strip contains a number of pouch-like compartments for holding weights. The weights may be rectangular lead wafers, lead shot or stones.

Known weighted apparel, such as discussed above, has been found to enhance stamina, strengthen the wearer's muscles and promote better exercise form during exercise activities. Such known apparel typically includes weight members positioned about the wearer in a manner specifically designed to promote the development of muscle tone and muscle form, and is, generally, not designed to promote bone development and bone stimulation. Additionally, many of the known weighted apparel designs employ relatively large, rigid weight members which do not conform well to the wearer's body movements, bends and flexures during physical activities. Many of such known weighted apparel designs employ mechanisms which allow weights to separate from the wearer's body and shift around during strenuous physical activities. For example, many of such known apparel designs employ weighted matter in the form of sand, lead shot, stones, or similar material which tends to displace and shift, constantly changing pressure points and overall balance, during physical activities. Furthermore, many of such known weighted apparel designs employ relatively large, bulky weights, such as pouches of sand or sacks of water, which tend to hinder some body movements and which tend to be relatively uncomfortable and cumbersome to support.

SUMMARY OF THE DISCLOSURE

The present invention relates to exercise or physical therapy apparel and weight packets therefor. As will become apparent from the description below, embodiments of the present invention provide several significant improvements and advantages over the above described known weighted apparel. Embodiments of the invention are designed, not only to promote muscle development and form, but also for promoting bone stimulation and bone development (e.g., for promoting bone mineralization). Embodiments are also designed for providing an improved snug fit of weights against a wearer's body. Further embodiments are designed for improved comfort and flexibility.

An embodiment of the invention comprises a vest garment, a pants garment, a spine strap, a belt, a pair of wrist bands, a pair of ankle bands and a plurality of weight packets. Of course, other embodiments may omit any one or combination of the pants garment, spine strap, belt, wrist bands and ankle bands, or any one or combination of the vest garment, spine strap, belt, wrist bands and ankle bands.

The vest garment and the pants garment, according to an embodiment of the invention, are each provided with means for holding weight packets snugly against a wearer's body. Each weight packet comprises a pouch containing a number of individual weight members arranged in plural rows and plural columns. The weight packets are bendable and flexible in a plurality of directions so as to readily conform to bends and flexes of the wearer's body.

The spine strap may be used as a weight packet secured to the vest along the wearer's spine. The belt may be used as a weighted belt secured around a wearer's waist or hips. Wrist and ankle bands each comprise a weight packet formed in a loop or formed in a strip fastened into a loop through which the wearer's wrist or ankle may extend.

The weighted garments may be worn individually or in various combinations as desired, resulting in weighted exercise or physical therapy apparel which provides significant improvements and advantages over such known apparel as discussed above in the "Related Art" section.

For example, any one or combination of the following significant advantages are provided by various embodiments of the present invention:

1. Weight packets are flexible in a plurality of directions so as to comfortably conform to a variety of physical motions of the wearer's body;

2. Weight packets are held snugly against a wearer's body even while conforming to physical motions, bends and flexures of the wearer's body;

3. Weight packets are relatively flat so as to minimize bulging and so as to maintain the center of gravity of the weight packets as close as possible to the body, even while the weight packets are bending to conform to physical motions of the wearer's body;

4. Weight packets are arranged about the wearer's body at locations which promote bone development and bone stimulation; and 5. The combination of the vest, pants, spine strap, belt, wrist bands and ankle bands, according to an embodiment of the invention, provides a highly flexible, free flowing weighted exercise suit which is held snugly to a wearer's body even while the wearer moves, bends or flexes in a variety of physical motions, providing an excellent weighted suit for free flowing movements such as aerobic exercises as well as for common, everyday movements.

These and other advantages will become apparent from the following detailed description and the accompanying drawings.

BRIEF DESCRIPTION OF THE DRAWINGS

The detailed description of embodiments of the invention will be made with reference to the accompanying drawings, wherein like numerals designate corresponding parts to the several figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims. The following description is made with reference to body parts of a person wearing the apparel ("the wearer"). However, it will be understood that neither the wearer nor the wearer's body form parts of the following embodiments.

Exercise or physical therapy apparel, according to an embodiment of the invention, is shown in FIGS. 1 through 8. An embodiment of the invention comprises a vest garment, a pants garment, a spine strap, a belt, a pair of wrist bands, a pair of ankle bands and a plurality of weight packets. Of course, other embodiments may omit any one or combination of the pants garment, spine strap, belt, wrist bands and ankle bands, or any one or combination of the vest garment, spine strap, belt, wrist bands and ankle bands.

Figure 1:
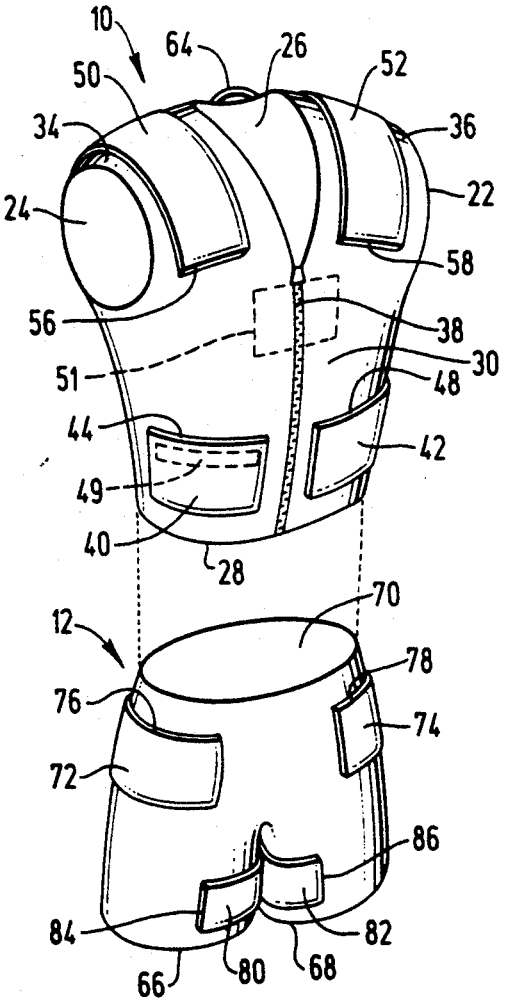
FIG. 1 shows a front, prospective view of weighted apparel according to an embodiment of the invention.
Figure 2:
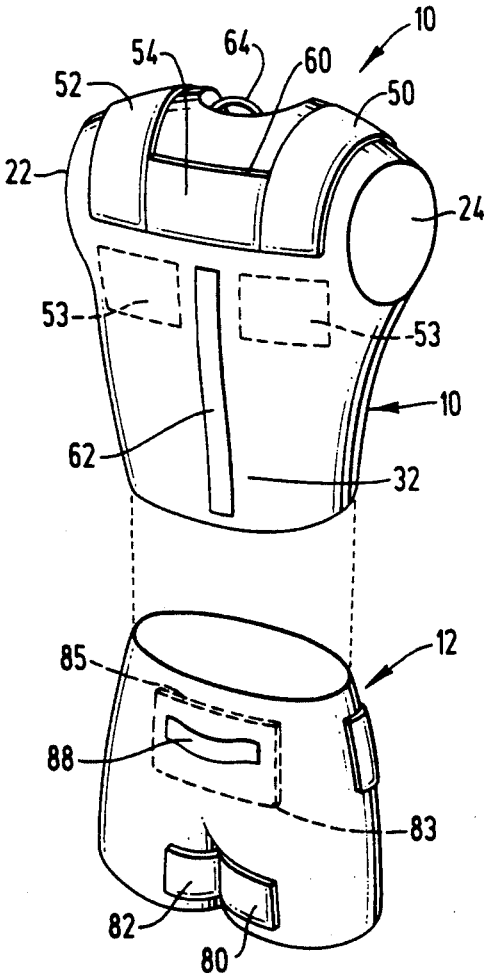
FIG. 2 shows a rear, perspective view of the apparel shown in FIG. 1.
Figure 3:
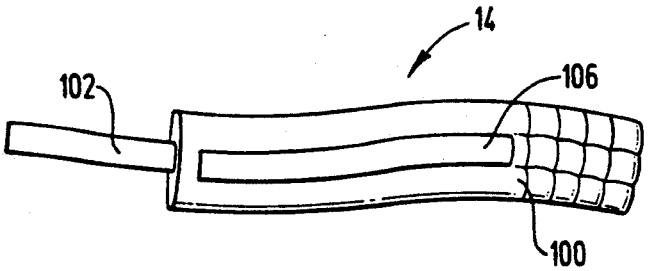
FIG. 3 shows a perspective view of a spine strap according to an embodiment of the invention.
Figure 4:
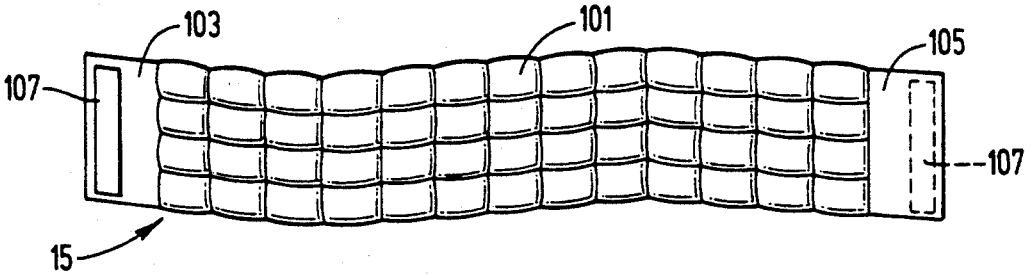
FIG. 4 shows a perspective view of a belt according to an embodiment of the invention.
Figure 5:
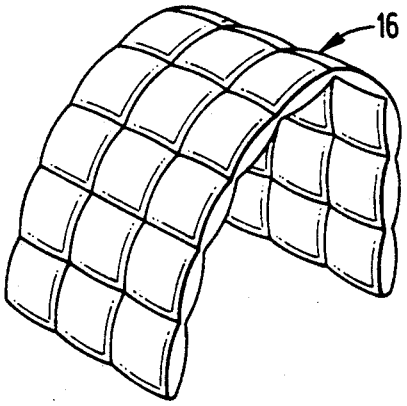
FIG. 5 shows a perspective view of a weight packet, according to an embodiment of the invention.
Figure 6:
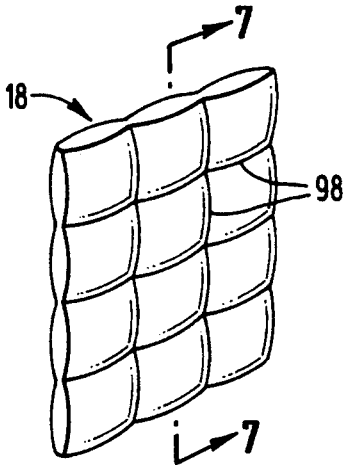
FIG. 6 shows a perspective view of another weight packet according to an embodiment of the present invention.
Figure 7:
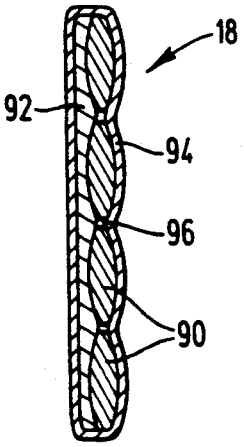
FIG. 7 shows a cross section view of the weight packet shown in FIG. 6.
Figure 8:
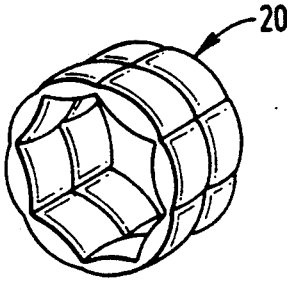
FIG. 8 shows an ankle or wrist band according to an embodiment of the invention.

Specifically, FIGS. 1 and 2 show a front and back view, respectively, of an upper body garment or vest garment 10 ("vest 10") and a lower body garment or pants garment 12 ("pants 12"). FIG. 3 shows a spine strap 14 which secures to the back panel of vest 10. FIG. 4 shows a belt 15 which wraps about the wearer's waist or hips. FIGS. 5–7 show embodiments of weight packets 16 and 18 which are received at various locations on vest 10 and pants 12. FIG. 8 shows a wrist or ankle band. According to an embodiment of the invention, the garments and weight packets shown in FIGS. 1–8, as a combination, form a free-flowing, comfortable weighted suit which may be worn during exercise or physical therapy activities or, alternatively, during normal, every-day activities, such as during housework, errands or even at the office.

The vest garment, according to the embodiment illustrated in FIG. 1 and 2 comprises a vest 10 provided with a pocket located over the front lower portion of each half of a wearer's rib cage, a pocket extending over the wearer's shoulder from just above the breasts to a position over the shoulder blades and a pocket along the wearer's back behind the collarbone. Further pockets may be provided over the back of the wearer's ribs and over the wearers sternum. Each pocket is provided to receive a weight packet as further described below.

The pants garment, according to the embodiment shown in FIGS. 1 and 2, comprises a pair of short cut pants 12 having a pocket located over the front and around a portion of the side of each of the wearer's upper hips and a pocket wrapped partially around each leg along each inner thigh. A further pocket may be provided over the wearer's sacrum. Each of the pants pockets is provided to receive a weight packet as further described below.

Each weight packet 16 or 18, according to the embodiments shown in FIGS. 5–7, comprises a closed cloth pouch containing a number of individual weight members arranged in plural rows and plural columns and a layer of padding material on one side of the columns and rows of weight members. Each weight member in the illustrated embodiment comprises a solid tile or disc of dense material, such as lead or lead alloy. Stitching between the individual weight members holds the plural columns and plural rows of weight members in place, yet allows individual columns to pivot with respect to other columns and allows individual rows to pivot with respect to other rows. This ability of the individual columns or rows of the weight members to pivot with respect to other columns and rows allows the weight packets to be highly flexible and to bend to conform to a variety of body movements while maintaining a snug fit against the wearer's body.

The spine strap 14, according to the embodiment shown in FIG. 3, comprises an elongated weight packet, such as described above. The elongated weight packet is provided with a thin, flexible strap extending from one end in the elongated direction of the weight packet. A strip of hook or loop fastening material extends, in the elongated direction, along one side of the elongated weight packet. A corresponding strip of the other of the hook or loop fastening material extends along the center of the back of the vest garment, such that the spine strap may be removably secured to the vest garment, along the wearer's spine, by engaging the hook and loop material strips on the spine strap and the vest.

An upper loop is provided below the back neckline of the illustrated vest garment and a lower loop is provided just below the belt line on the illustrated pants garment. The upper loop is provided to receive the thin strap, extending from the elongated weight packet. The thin strap may be tied or otherwise fastened through the loop to further secure the spine strap to the vest garment. When spine strap 14 is secured to the vest, the lower end of the spine strap extends through the lower loop of the pants garment to maintain the spine strap against the wearer's spine.

The belt 15, according to the embodiment shown in FIG. 4, comprises a elongated weight packet. The elongated weight packet is provided with first and second end straps extending from opposite ends in the elongated direction of the weight packet. Fastening means, such as hook and loop fastening material, a belt buckle, clips, snaps or the like are provided on the end straps so as to allow belt 15 to be fastened around a wearer's waist or hips.

Each wrist and ankle band 20, according to the embodiment shown in FIG. 8, comprises a weight packet, such as described above, but formed in a loop through which a wearer's wrist or ankle may extend. The illustrated embodiment employs an elastic fabric or cloth around the weight members so that the diameter of the loop may be resiliently expanded for putting on or removing the band. Alternatively, the weight packet of each wrist and ankle band may be formed as an elongated strip having fastening means (such as hook and loop fastening material, clips, snaps, buckles or the like) for fastening the strip into a loop configuration.

As will be explained in further detail below, the weight packets are uniquely designed to be held tightly against a wearer's body and to freely bend and conform to the wearer's body movements. Also as described below, the weight packets are relatively flat and relatively non-obtrusive so as not to hinder body or limb motions. As further described below, weight packets are attached to locations about the vest and pants which not only enhance muscle development and stimulation, but also enhance dynamic bone stimulation, bone strengthening and bone development during physical activities.

Each of the above described garments and accessories is described in further detail below:

The Vest

The vest 10 shown in FIGS. 1 and 2 comprises a sleeveless garment to be worn over the wearer's chest and back. Vest 10 includes two arm openings 22 and 24, a neck opening 26 and a torso opening 28. In the illustrated embodiment, neck opening 26 defines a V-type neckline. However, it is contemplated that other neckline styles may be employed without departing from the present invention. It is also contemplated that the garment may include short or long sleeves, as opposed to the sleeveless embodiment shown in FIG. 1, without departing from the scope of the invention.

Vest 10 includes a front panel 30, which extends over a wearer's chest, and a back panel 32 (best shown in FIG. 2), which extends over the wearer's back. A right shoulder portion 34 extends from front panel 30 to back panel 32, between right arm opening 24 and neck opening 26. Similarly, a left shoulder portion 36 extends from front panel 30 to back panel 32 between left arm opening 22 and neck opening 26.

In the embodiment shown in FIG. 1, the vest is split along front panel 30 from neck opening 26 to torso opening 28 and a zipper mechanism 38 extends along the split. However, it is contemplated that other embodiments may employ buttons, tie strings, hook and loop fasteners (for example, of the type known by the trademark VELCRO) or other suitable fasteners instead of zipper mechanism 38. It is also contemplated that embodiments of vest 10 may include a front panel 30 which is not split from neck opening 26 to torso opening 28 and therefore would not require a zipper mechanism, buttons, tie straps or other fastening means as shown in FIG. 1.

In a preferred embodiment, vest 10 is made of a flexible, tight fitting and somewhat elastic material, such as a spandex or spandex blend material. However, other suitable materials may be employed without departing from the scope of the invention. In a preferred embodiment, the material from which vest 10 is made contributes to a snug, tight fitting characteristic of the vest. As will be described in further detail below, such tight fitting characteristic of vest 10 allows weight packets (discussed below) to be held relatively snug against a wearer's body, on the outside of the vest, even during strenuous motions, bends or flexures of the wearer's body. Alternatively, pockets may be located on the inside of vest 10 such that the weight packets are held relatively snug against the wearer's body on the inside of the vest.

In the embodiment shown in FIG. 1, vest 10 is provided with right and left torso pockets 40 and 42, respectively. In a preferred embodiment, torso pockets 40 and 42 are arranged so as to be located over the lower portion of the right and left halves of a wearer's rib cage. Each pocket 40 and 42 includes an opening 44 and 48, respectively, through which a weight packet (such as described below) may be inserted or removed. Opening 44 of pocket 40 is shown in an open condition in FIG. 1, while opening 48 of pocket 42 is shown in a closed position in FIG. 1. Preferably, fastening means 49, such as hook and loop fastening material, buttons, zippers or the like are provided at each opening 44 and 48 so as to selectively fasten the openings closed so as to close pockets 40 and 42, respectively.

In the embodiment shown in FIGS. 1 and 2, vest 10 is further provided with right and left shoulder pockets 50 and 52, respectively. Right shoulder pocket 50 extends over right shoulder portion 34 of vest 10 from a location which would be generally just above the wearer's right breast to a location over the wearer's right shoulder blade. Left shoulder pocket 52 is similarly arranged over left shoulder portion 36 of vest 10. As shown in FIG. 2, an upper spine pocket 54 is arranged on back panel 32, between right and left shoulder pockets 50 and 52.

Similar to pockets 40 and 42 discussed above, each pocket 50, 52 and 54 is provided with an opening (opening 56 of pocket 50, opening 58 of pocket 52 and opening 60 of pocket 54). Openings 56, 58 and 60 may be provided with fastening means for selectively closing the opening to close the associated pocket, similar to fastening means 49. As will be described in further detail below, each pocket 40, 42, 50, 52 and 54 is provided to receive a weight packet.

In further embodiments, pockets are provided over the wearer's sternum (as shown at 51 by broken lines) and/or over the back of the wearer's ribs (as shown at 53 by broken lines) to similarly receive weight packets. It is preferred that each pocket be dimensioned to closely correspond to the dimensions of the weight packet to be received therein so as to minimize or prohibit movement of the weight packet when it is received within the pocket.

According to an embodiment of the invention, back panel 32 is provided with a strip of loop type fastening material 62, centrally located so as to extend over a wearer's spinal cord. A loop of material 64 is sewn into vest 10, just below the rear neckline of neck opening 26 on pack panel 32. As will be described in further detail below, strip 62 and loop 64 are provided for securing a spine strap 14 to back panel 32 so as to extend along a wearer's spine.

The Pants

An embodiment of pants 12 is shown in FIGS. 1 and 2. According to the illustrated embodiment, pants 12 comprises a short cut pair of pants (although long pants, e.g. slacks, may alternatively be employed) having a right leg opening 66, a left leg opening 68 and a torso opening 70. Right and left hip pockets 72 and 74, respectively, are provided on pants 12 at a location over the front and partially over the side of a wearer's right and left hips, respectively. Right hip pocket 72 is provided with an opening 76 and left hip pocket 74 is provided with an opening 78. Openings 76 and 78 are provided to allow weight packets to be inserted into or removed from pockets 72 and 74, respectively.

Pants 12 are also provided with right and left thigh pockets 80 and 82, respectively, and may also or alternatively include a sacrum pocket 83. Thigh pockets 80 and 82 wrap partially around a wearer's right and left legs, respectively, along the inner thigh of each leg. Sacrum pocket 83 is provided over the wearer's sacrum as shown in broken lines in FIG. 2. Pocket 80 is provided with an opening 84, pocket 82 is provided with an opening 86 and pocket 83 is provided with an opening 85 through which a weight packet may be inserted or removed. Similar to the pockets provided on vest 10, pockets provided on pants 12 may also include fastening means for selectively fastening the pocket openings and the pockets closed. It is preferred that the material employed for pants 12 be the same or similar material as employed for vest 10. However, suitable material other than that used for vest 10 may be employed for pants 12 without departing from the invention.

As shown in FIG. 2, pants garment 12 is provided with a loop 88 arranged on the back of the pants. As will be described in further detail below, loop 88 is provided for further securing and guiding spine strap 14 in an embodiment wherein vest 10, pants 12 and spine strap 14 are employed in combination. That is, the lower end of elongated weight packet 100 of spine strap 14, upon securing spine strap 14 to vest 10, is inserted through loop 88. In this manner, spine strap 14 is further held against the wearer's spine. However, the lower end of packet 100 will be allowed to freely slide in the vertical direction within loop 88 so as not to restrict stretching or bending of the wearer's spine. Thus, loop 88 guides the lower end of packet 100 for movement in the vertical direction as the wearers's spine is bent, unbent, stretched and compressed during physical activities.

As an alternative embodiment to the use of pockets, each pocket on the vest 10 or pants 12 may be replaced with a patch of hook (or loop) type fastening material (not shown). In such an embodiment, the weight packets are each provided with a patch of loop (or hook) type fastening material designed to engage and secure with a patch of loop type material provided on vest 10 or pants 12. In this manner, weight packets 16 and 18 may be releasably secured to vest 10 or pants 12, in similar positions and arrangements as shown in FIGS. 1 and 2, merely be engaging the patches of hook and loop materials on the vest or pants and on the weight packets.

The Weight Packets

FIGS. 5, 6 and 7 show weight packets according to an embodiment of the present invention. Weight packet 16 shown in FIG. 5 is an example of a weight packet which is dimensioned to fit, e.g., within a shoulder pocket 50 or 52. Weight packet 16 is shown in FIG. 5 in a curved or inverted U-shape configuration. However, it will be understood that weight packet 16 is highly flexible and may be laid flat or bent in the opposite direction. In a preferred embodiment, a weight packet 16 is provided within each shoulder pocket 50 and 52 and a similar weight packet (however, preferably shorter in length) is held within each of the right and left thigh pockets 80 and 82 of pants 12.

Weight packet 18 shown in FIG. 6 is dimensioned to fit within any one of pockets 40 and 42 of vest 10 or pockets 72 or 74 of pants 12. In a preferred embodiment, a separate weight packet 18 is held in each of pockets 40, 42, 72 and 74 and a similar weight packet is provided to be received in pocket 54.

Weight packets may be removed before washing the vest or pants. Additionally, the weight packets may be inserted in some, but not all of the pockets to vary the workout or stimulation process. A variety of weight packets, each having various overall weights, may be provided so that the wearer can choose the weight to employ for a particular workout.

According to the illustrated embodiments, weight packets 16 and 18 have a mosaic appearance, due to the internal structure of these packets. As will become apparent from the cross section of weight packet 18 shown in FIG. 7, each weight packet includes a plurality of independent weight members 90 arranged in a column. As shown in FIGS. 5 and 6, each weight packet includes a plurality of columns and a plurality of rows of weight members. This arrangement of plural columns and plural rows allows the weight packets to be highly flexible in a plurality of directions, as will be described in further detail below. Additional embodiments of the invention may include weight packets wherein individual weight members are arranged in configurations other than linear rows and columns.

Referring to FIG. 7, a cross section of weight packet 18 is shown. The cross section of FIG. 7 reveals one column of individual weight members 90. Each weight member comprises a dense body (or bodies), such as a solid disk (or stacked disks) or a solid, one inch square tile (or stacked tiles) of lead or lead alloy material. Other suitable materials and shapes for the dense body may be employed without departing from the invention.

A layer of padding material 92 is arranged on one side of the columns and rows of weight members 90. An outer cloth layer 94 surrounds the padding layer 92 and the rows and columns of weight members 90. Preferably, a small gap 96 is provided between each adjacent weight member in each column of weight members and between each adjacent weight member in each row of weight members. The separation of adjacent weight members 90 allows each individual column of weight members to pivot with respect to an adjacent column. Similarly, each row of weight members 90 may pivot with respect to an adjacent row of weight members. As a result, the entire weight packet is able to readily bend and contort to conform to bends and contortions of a wearer's body.

Preferably, cloth outer layer 94 surrounds the entire weight packet so as to provide a closed, highly flexible packet of weight members. In a preferred embodiment, stitching 98 may be provided in cloth layer 94, between each adjacent weight member in each column of weight members and in each row of weight members. Stitching 98 ensures that individual weight members are maintained within a defined area of the weight packet. As a result, individual weight members 90 will be inhibited from moving out of their defined areas inside of the weight packet during strenuous physical activity. Each weight packet is configured to fit within a pocket 40, 42, 50, 52, 54, 72, 74, 80 or 82, with the padding layer 92 arranged between the plural rows and columns of weight members 90 and the vest or pants material against the wearer's body. In this manner, padding layer 92 provides a cushion between the rigid weight members 90 and the wearer's body.

The Spine Strap

FIG. 3 shows a spine strap 14 according to an embodiment of the invention. Strap 14 comprises an elongated weight packet 100. A thin, flexible strap 102 extends from an end of elongated weight packet 100, in the elongated direction of packet 100. A strip of hook-type fastening material 106 extends along the length of elongated weight packet 100, in the elongated direction thereof.

According to an embodiment of the invention, strap 14 is secured to vest 10 and pants 12 by engaging hook material 106 with loop material 62 (on back panel 32 of vest 10) and by tying strap 102 to loop 64 of vest 10. Strap 104 may be tied to loop 88 of pants 12. In this manner, strap 14 is secured and extended along a wearer's spinal cord. In an alternate embodiment, hook material may be provided on vest 10 and loop material may be provided on elongated weight packet 100.

A further embodiment includes fastening means (such as hook and loop material, clips, snaps, buckles or the like) on thin strap 102 to fasten strap 102 through loop 64. For example, a patch of hook or loop type fastening material (not shown) may be provided on strap 102 and a patch of the other of the hook and loop material (not shown) may be provided on elongated weight packet 100 (e.g. on the opposite side of packet 100 with respect to the side on which material 106 is provided). Thin strap 102 may be secured through loop 64 by extending strap 102 through loop 64 and engaging the patch of hook or loop material on thin strap 102 with the patch of hook or loop material on elongated weight packet 100.

In further embodiments, the spine strap, or a similar strap, may be secured to the vest along a wearer's right or left side or to the pants along the right or left leg. Several of such straps may be provided to extend in any combination of the above discussed locations along the wearer's body. Such straps secure to the vest or pants using similar fastening means as discussed above with respect to spine strap 14.

The Belt

FIG. 4 shows a belt 15 according to an embodiment of the invention. Belt 15 comprises an elongated weight packet 101 having first and second flexible end straps 103 and 105, respectively, extending from opposite ends of elongated weight packet 101 in the elongated direction. Fastening means 107, such as hook and loop fastening material, a belt buckle, clips, snaps or the like are provided on end straps 103 and 105 so as to allow belt 15 to be fastened around a wearer's waist or hips. Belt 15 may be used independently of vest 10 and pants 12, in conjunction with vest 10, in conjunction with pants 12, or in conjunction with both vest 10 and pants 12.

The Wrist and Ankle Bands

FIG. 8 shows an embodiment of a band 20 which may be employed as an ankle band or a wrist band. Band 20 comprises a weight packet, such as described above, formed in a loop. In a preferred embodiment, the cloth layer 94 of the weight packet employed for band 20 comprises an elastic material which will allow the loop of band 20 to expand or contract to expand or contract the diameter of the loop. By expanding the diameter of the loop, band 20 may be readily pushed over a wearer's hand or foot, after which the band is allowed to contract around the wearer's wrist or ankle. Similar expansion and contraction of loop 20 may be accomplished for removing band 20 from the wearer's wrist or ankle.

Alternatively, each ankle or wrist band may be formed as an elongated weight packet strip having fastening means (such as hook and loop fastening material, snaps, clips, buckles or the like), not shown, for fastening the weight packet into a loop configuration as shown in FIG. 8. In this alternate embodiment, cloth layer 94 of the weight packet may be either elastic or non elastic material.

According to an embodiment of the invention, a weighted suit comprises a vest 10, pants 12, at least one spine strap 14, belt 15, two ankle bands and two wrist bands, and a plurality of weight packets. The combination of these garments provide a unique weighted suit which may be employed for exercise, physical therapy or merely worn during normal, every day activities. In further embodiments, various combinations of the above described garments may be worn. Alternatively, a wearer may wear only one of the vest, pants, belt, wrist band and ankle band.

The ability of the weight packets to freely bend and contort to correspond to bends and contortions of the wearer's body, as well as the ability of the material of the vest and pants to hold the weight packets snugly against the wearer's body provides a comfortable, free flowing and highly flexible weighted exercise suit. Such free flowing, high flexibility is especially beneficial for accommodating free flowing, bending and flexing motions of various aerobic exercises, dances or sports activities.

Placement of the weight packets, as discussed above, e.g., against the wearer's ribs and rib cage (front and back), over the wearer's shoulder and collarbone, around the back of the wearer's neck, along the wearer's spine, adjacent the wearer's hip bones, sternum and sacrum, along the wearer's inner thighs, around the wearer's waist or hips, around the wearer's wrists and around the wearer's ankles applies a light pressure to the underlying bones, providing significant bone stimulating and therapeutic benefits. Placement of weight packets, as indicated, is believed to stimulate the wearer's underlying bones to enhance mineralization of the bones and to enhance the internal piezo electric phenomenon (electrical impulse signals within the body resulting from pressure applied to locations on the body). Such placement of the weights is also believed to improve the wearer's posture, by providing pressure along the wearer's shoulders, collar bone and spine.

The weight packets, being relatively flat, may be easily inserted within pockets of the vest 10 or pants 12 and, while held by vest 10 or pants 12, may be easily hidden under clothing. In this manner, the weight suit or individual weighted garments may be worn under a wearer's normal clothing or during every-day activities, such as grocery shopping, house cleaning, or even to the office. As a result, exercise or therapeutic benefits may be achieved during such every-day activities.

While the description above refers to particular embodiments of the present invention, it will be understood that many modifications may be made without department from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of the equivalency of the claims are therefore intended to be embraced therein.

What is claimed is:

1. Weighted apparel to be worn by a wearer, the apparel comprising:

an upper body garment to be worn above the wearer's waist;

a weight packet;

means for securing the weight packet to the upper body garment; and the weight packet comprising a plurality of rows and a plurality of columns of weight members inside a pouch.

2. Weighted apparel to be worn by a wearer, the apparel comprising:

an upper body garment;

a weight packet;

means for securing the weight packet to the upper body garment;

the weight packet comprising a plurality of rows and a plurality of columns of weight members inside a pouch; and wherein the weight packet further comprises padding material on one side of the rows and columns of weight members.

3. Apparel as claimed in claim 1, wherein the weight packet further comprises stitching between each pair of adjacent weight members in each column and row so as to maintain the weight members in the plural columns and rows.

4. Weighted apparel to be worn by a wearer, the apparel comprising:

an upper body garment;

a weight packet;

means for securing the weight packet to the upper body garment;

the weight packet comprising a plurality of rows and a plurality of columns of weight members inside a pouch; and wherein each weight member comprises a relatively flat tile of at least one of a lead and a lead alloy material.

5. Apparel as claimed in claim 2 wherein the weight packet further comprises stitching between each pair of adjacent weight members in each column and row so as to maintain the weight members in the plural columns and rows.

6. Apparel as claimed in claim 5, wherein the weight member comprises a relatively flat tile of at least one of a lead and a lead alloy material.

7. Apparel as claimed in claim 2, wherein the weight member comprises a relatively flat tile of at least one of a lead and a lead alloy material.

8. Weighted apparel to be worn by a wearer, the apparel comprising:

an upper body garment;

a weight packet;

means for securing the weight packet to the upper body garment;

the weight packet comprising a plurality of rows and a plurality of columns of weight members inside a cloth pouch;

wherein the weight packet further comprises stitching between each pair of adjacent weight members in each column and row so as to maintain the weight members in the plural columns and rows; and wherein each weight member comprises a relatively flat tile of at least one of a lead and a lead alloy material.

9. Apparel as claimed in claim 1, further comprising pants having weight packet attaching mean for releasably attaching at least one weight packet thereto.

10. Apparel as claimed in claim 1 wherein the weight attaching means comprises a pocket.

11. Apparel as claimed in claim 1, further comprising a plurality of weight packets, wherein the weight attaching means comprises a plurality of pockets, wherein each weight packet is associated with a corresponding pocket.

12. Apparel as claimed in claim 1, wherein the weight attaching means comprises a patch of at least one of a hook and loop material provided on the upper body garment and a corresponding patch of the other of the hook and loop material provided on the weight packet.

13. Weighted apparel to be worn by a wearer, the apparel comprising:

a vest defining a front panel which extends over a wearer's chest and rib cage when worn, a back panel which extends over a wearer's back and spine when worn and shoulder portions which extend over a wearer's right and left shoulders when worn;

a plurality of weight packets, including a pair of rib cage weight packets, a right shoulder weight packet and a left shoulder weight packet;

means for securing the pair of rib cage weight packets to the vest at a location over the wearer's right and left rib cage halves when worn;

means for securing the right shoulder weight packet to the vest over the wearer's right shoulder when worn;

means for securing the left shoulder weight packet over the wearer's left shoulder when worn; and wherein each weight packet comprises a plurality of rows and a plurality of columns of weight members inside of a pouch.

14. Weighted apparel to be worn by a wearer, the apparel comprising:

an upper body garment;

a weight packet;

means for securing the weight packet to the upper body garment;

the weight packet comprising a plurality of rows and a plurality of columns of weight members inside a pouch;

wherein the weight attaching means comprises a patch of at least one of a hook and loop material provided on the upper body garment and a corresponding patch of the other of the hook and loop material provided on the weight packet; and the apparel further comprising an elongated weight packet and means for securing the elongated weight packet to the vest over the wearer's spine when worn.

15. Apparel as claimed in claim 13, further comprising pants having weight packet attaching means for releasably attaching at least one weight packet thereto.

16. Weighted apparel to be worn by a wearer, the apparel comprising:

a vest defining a front panel which extends over a wearer's chest and rib cage when worn, a back panel which extends over a wearer's back and spine when worn and shoulder portions which extend over a wearer's right and left shoulders when worn;

a plurality of weight packets, including a pair of rib cage weight packets, a right shoulder weight packet and a left shoulder weight packet;

means for securing the pair of rib cage weight packets to the vest at a location over the wearer's right and left rib cage halves when worn;

means for securing the right shoulder weight packet to the vest over the wearer's right shoulder when worn;

means for securing the left shoulder weight packet over the wearer's left shoulder when worn;

wherein each weight packet comprises a plurality of rows and a plurality of columns of weight members inside of a pouch; and wherein each weight packet further comprises padding on one side of the rows and columns of weight members.

17. Apparel as claimed in claim 15, wherein each weight packet further comprises stitching between each pair of adjacent weight members in each column and row so as to maintain the weight members in the plural columns and rows.

18. Apparel as claimed in claim 16, wherein each weight member comprises a relatively flat tile of at least one of a lead and a lead alloy material.

19. Weighted apparel to be worn by a wearer, comprises:

a vest defining a front panel which extends over a wearer's chest and rib cage when worn, a back panel which extends over a wearer's back and spine when worn and right and left shoulder portions which extend over a wearer's right and left shoulders, respectively, when worn;

a plurality of weight packets, each weight packet comprising a plurality of rows and a plurality of columns of weight members inside of a cloth pouch, padding on one side of the rows and columns of weight members, and stitching between each pair of adjacent weight members in each column and row so as to maintain the weight members in the plural columns and rows, each weight member comprising a relatively flat tile of at least one of a lead and lead alloy material, the plurality of weight packets including first and second rib cage weight packets, and right and left shoulder weight packets;

means for securing the first and second rib cage weight packets to the vest at a position over the right and left halves of the wearer's rib cage when the vest is worn;

means for securing the right shoulder weight packet to the vest over the wearer's right shoulder when the vest is worn;

means for securing the left shoulder weight packet to the vest over the wearer's left shoulder when the vest is worn; and pants having weight packet attaching means for removably attaching weight packets to the portions of the pants which are over the wearer's right and left hips when the pants are worn.

20. Apparel as claimed in claim 20, further comprising a pair of ankle bands and a pair of wrist bands, each ankle band and each wrist band comprising a weight packet provided in a loop configuration.

21. A weighted belt to be worn about a wearer's waist or hips, the belt comprising:

an elongated weight packet;

the weight packet comprising a pouch, a plurality of rows and a plurality of columns of individual weight members disposed in a corresponding plurality of predefined areas inside the pouch and stitching provided to separate the predefined areas wherein each weight member comprises a relatively flat tile; and fastening means for fastening the elongated weight packet about the wearer.

* * * * *